US008333339B2

(12) United States Patent
Pallmann

(10) Patent No.: US 8,333,339 B2
(45) Date of Patent: Dec. 18, 2012

(54) DEVICE FOR THE WORKUP OF INPUT MATERIAL WITH A ROTOR-STATOR SYSTEM

(75) Inventor: Hartmut Pallmann, Zweibrücken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 323 days.

(21) Appl. No.: 12/777,773

(22) Filed: May 11, 2010

(65) Prior Publication Data

US 2010/0282888 A1 Nov. 11, 2010

(30) Foreign Application Priority Data

May 11, 2009 (DE) ..... 10 2009 020 712

(51) Int. Cl.
*B02C 18/18* (2006.01)

(52) U.S. Cl. ..... 241/242

(58) Field of Classification Search ..... 241/300.1, 241/242, 243

See application file for complete search history.

(56) References Cited

U.S. PATENT DOCUMENTS 3,779,123 A * 12/1973 Chafee ..... 83/698.41
5,297,746 A * 3/1994 McBride et al. ..... 241/242
5,829,700 A * 11/1998 Pianca et al. ..... 241/300.1
2008/0135658 A1 6/2008 Pallmann et al.

FOREIGN PATENT DOCUMENTS

DE 102 22 814 B4 3/2007
DE 10 2006 056 542 A1 5/2008

* cited by examiner

*Primary Examiner* — Mark Rosenbaum
(74) *Attorney, Agent, or Firm* — Muncy, Geissler, Olds & Lowe, PLLC

(57) ABSTRACT

A device for processing free-flowing input material is provided that includes a rotor rotating around a shaft within a housing, the rotor being fitted over its circumference with rotor tools. Stator tools, permanently fixed to the housing, are arranged, which are disposed opposite the rotor tools allowing a working gap and interact with the rotor tools to process the input material. The stator tools are held in a holder, forming a tool unit. The tool units are made self-supporting over the length of the rotor and end sections of the tool units are fixed removably in respective clamping devices.

18 Claims, 4 Drawing Sheets

DEVICE FOR THE WORKUP OF INPUT MATERIAL WITH A ROTOR-STATOR SYSTEM

This nonprovisional application claims priority under 35 U.S.C. §119(a) to German Patent Application No. DE 10 2009 020 712.0, which was filed in Germany on May 11, 2009, and which is herein incorporated by reference.

BACKGROUND OF THE INVENTION

1. Field of the Invention

The invention relates to a device for the workup of input material with a rotor-stator system.

2. Description of the Background Art

The purpose of the mechanical processing technique is the workup of input material, wherein in particular the comminution of materials is of great importance, in other words, the conversion of substance from a given initial size to a smaller intermediate or final size. However, the present invention is also understood to include workup of the input material in which mere size reduction of the material is not paramount, but which involves breaking up the bonding of the components forming a composite material. This can also be done by comminution of at least one component of the composite material. Correspondingly, the starting materials may be present in a form that is pure in type, for example, as plastic, metal, or wood, or as a mixture or composition, optionally bonded together, as is often the case with recycling material. Representative composite materials include electronics waste, plastic-coated cable residues, used tires, used wood containing nails, and the like.

Comminution devices include comminution devices with a rotor-stator system in which the comminution tools on the rotor interact with stationary comminution tools on the stator. For this purpose, the rotor tools located on a common circle of rotation are conveyed past stator tools of fixed position while maintaining a working gap. The work of comminution is performed in the working gap between the rotor and stator tools, wherein the input materials, depending on the nature of the processing tools, are subjected to a cutting, shearing, mashing, tearing, chopping or striking process. The wear occurring during the use of such devices makes it necessary for both rotor tools and stator tools to be reset or replaced with sharpened or new tools at regular intervals. The stoppage times linked with this result in production losses and therefore strongly influence the economical operation of such comminution devices. Additional factors influencing the economy of devices of this class include maintenance, cleaning, and repair work, wherein the resulting expense depends greatly on the access to the interior of the device.

From DE 102 22 814 A1 a comminution device is known in which a roller rotor outfitted with knives is disposed in the center of a housing and interacts with stator tools of fixed position relative to the housing. The stator tools are screwed onto supporting beams directed coaxially to the rotor axis, said beams in turn being rigidly connected to the housing walls and in this way representing a supporting element within the overall machine construction. One drawback of such devices is that the stator tools are extensively attached to the bearing beams by screw connection, so that the work of screwing and unscrewing to be performed when loosening the screw connection when changing a knife result in long stoppage times for knife changes. In addition, the bearing beams rigidly connected to the housing permit only limited accessibility to the interior of the housing, thus getting in the way during cleaning, repair, and maintenance work.

With DE 10 2006 056 542 A1, which corresponds to U.S. Publication No. 20080135658, which is incorporated herein by reference, the need for rapid and simple adjustment, or optionally replacement, of the stator tools of devices of similar class was recognized and a solution to this problem was presented. Here each of the stator tools, together with the tool holders, represents a tool packet that can be slid axially into and out of the operating position. The fastening of the tool packets in their intended operating position takes place via a bearing beam welded to the opposite housing walls, opposite which an axially parallel clamping beam is movably located at a tangential distance. The tool packet is arranged between the bearing beam and the clamping beam, and is tensioned against the bearing beam with the aid of the clamping beam. Thus this device already made it possible to achieve the considerable advantage of accomplishing rapid exchange of the tool packets by simply loosening the clamp, thus minimizing the wear-related stoppage times of the device.

SUMMARY OF THE INVENTION

It is therefore an object of the invention to further develop devices to shorten wear- or maintenance-related stoppage times.

Before this invention was made, it was commonly believed by experts in the field that tool units having a stator tool and a holder must be supported along one or several longitudinal supports over the entire axial length of the comminution space. In addition to the supporting function for the tool units, the longitudinal supports had the further task of strengthening the machine frame by acting as supports.

The contribution of the present invention is to have escaped from this concept and instead to have designed the tool units to be self-supporting over the total length of the rotor from one housing wall to the opposite one.

A first advantage resulting from the avoidance of completely rigid support of the tool units is based on a simplified machine design. Since the tool units are self-supporting over the length of the rotor, thus do not need additional supporting elements, the number of component parts and thus the weight of the device is reduced. The savings of material and installation expenses thus achieved permit a more cost-advantageous production of devices according to the invention compared to known devices.

The terminal sections of the tool units are preferably passed through openings in the transverse walls of the housing to the outside, where they are fixed in gripping mechanisms. This has the advantage that the gripping mechanisms are readily accessible from the outside and therefore can be quickly tightened or loosened, and are not exposed to the wear-inducing mechanical stress imposed by the input material during the comminution operation. After the gripping mechanism is loosened, the possibility of rapid tool replacement via the axial or radial insertion and removal of the tool unit exists. This can advantageously be partially automated by using a cylinder piston unit.

It proves advantageous for the operator of devices according to the invention that no installations that cross through the comminution chamber are present after removal of the tool units. The accessibility for maintenance, repairs, or cleaning is therefore considerably improved.

According to an embodiment of the invention, gripping mechanisms are provided for fastening the tool units, in which the tool units are clamped against supporting surfaces. The supporting surfaces are formed by embrasure surfaces of openings in the housing walls, a fact that contributes to further simplifying the machine construction.

In an embodiment, because the tool units with their end sections are disposed in an accurately fitted manner into corresponding recesses or openings in the housing walls, it proves advantageous to provide radially acting lifting and retaining components, for example in the form of threaded pins, between the housing and tool units, which permit controlled loosening of the tool units in their supporting region to prevent damage and injuries to the operating personnel insofar as possible.

The goal of a simple but sturdy machine design is also systematically employed in the area of the tool units. In a preferred embodiment, the tool units comprise a one-piece, beam-like holder into which a recess for the stator tools is machined. Despite the simple machine design, here also a finely tuned adjustment of the projection of the stator tools above the support is possible in that thin-walled adjusting plates are introduced between the stator tools and the support surface in the holder.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
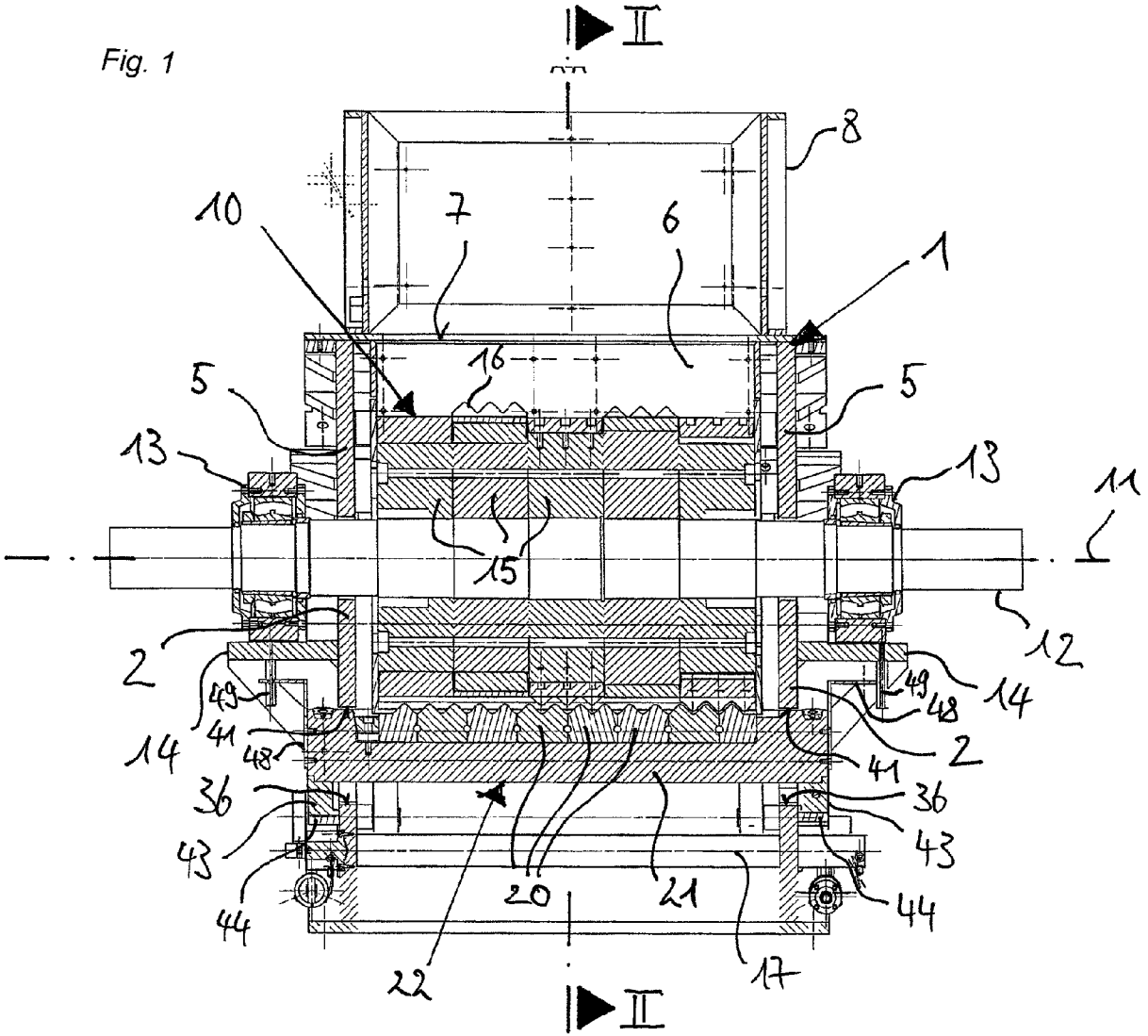
FIG. 1 is a longitudinal section through a device according to the invention along line I-I shown in FIG. 2.
Figure 2:
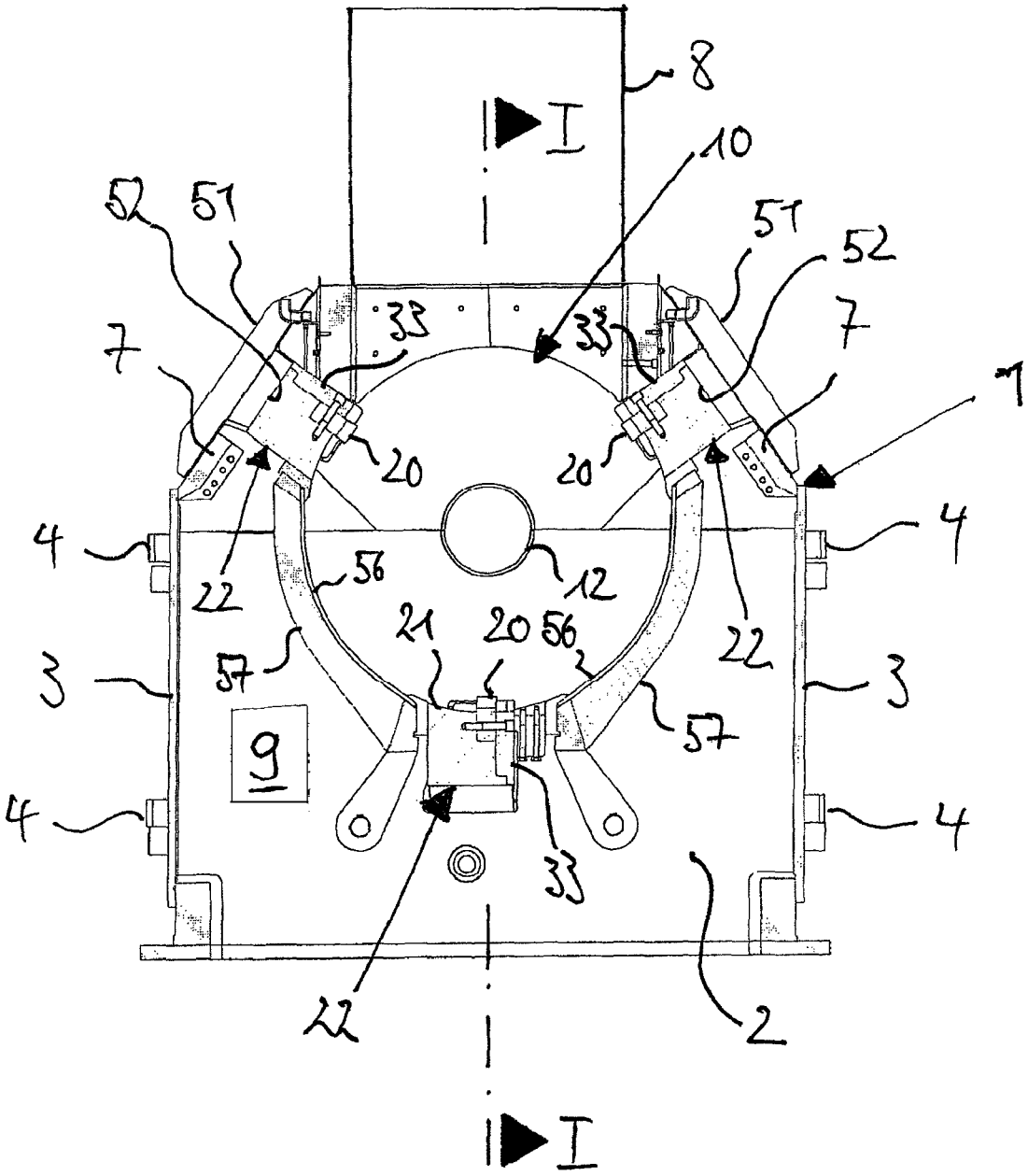
FIG. 2 is a cross section through the device shown in FIG. 1 along the line II-II there.
Figure 3:
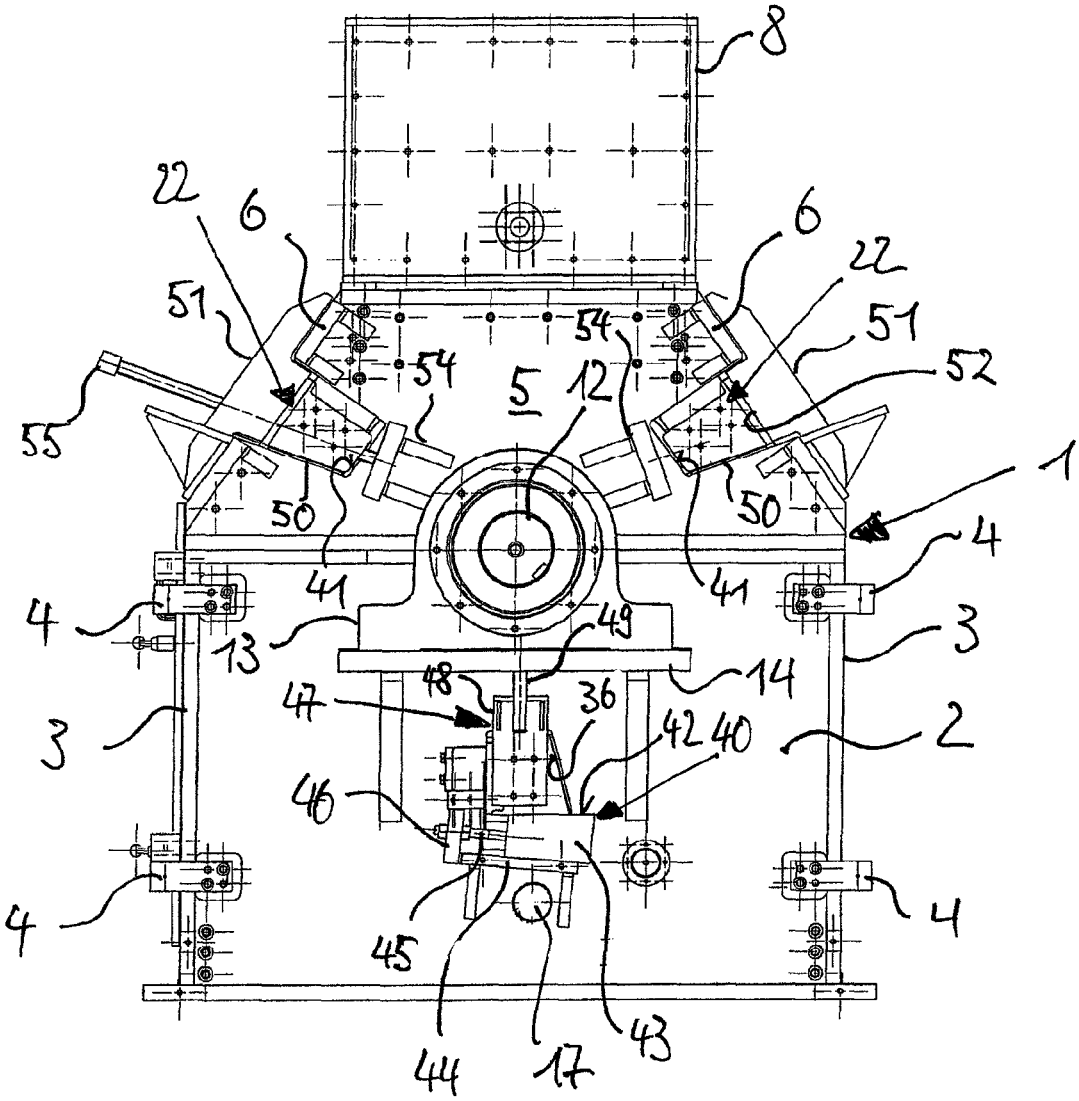
FIG. 3 is a side view of the device shown in FIGS. 1 and 2.

The detailed structure of a device according to the invention is shown in FIGS. 1-3. Said device has a housing 1, the lower housing part of which is formed by the transverse walls 2 and longitudinal walls 3. For opening the housing 1, the longitudinal walls 3 are fastened pivotably via the hinge 4 to the transverse walls 2. The following upper housing part has trapezoidal transverse walls 5 attached to this, the inclined edges of which are respectively connected by correspondingly inclined longitudinal walls 6. The upper edges of the transverse walls 5 and longitudinal walls 6 in this process form a rectangular opening 7, followed by a vertical input shaft 8 for filling the device with input material. The housing 1 thus surrounds a comminution chamber 9, which in the upper housing part expands from the opening 7 toward the interior. Toward the bottom, the housing 1 is open for withdrawing the input material after it has been processed.

At the level of the transition from the upper to the lower housing part, a rotor 10 extending parallel to the longitudinal walls 3 and 6 is seen, the axis of rotation of which is labeled with 11. The drive shaft 12 of the rotor 10 extends through openings in the transverse walls 2 and 5 and is held there in horizontal axial bearings 13, which in turn rest on mounting brackets 14 welded permanently to the outsides of the transverse walls 2 and 5 and thereby each maintain an axial distance from the transverse walls 2 and 5. The drive shaft 12 is coupled with a rotational drive not further illustrated, which can be driven in both the left-hand and the right-hand direction.

Within the housing 1, irrotatably fixed on the drive shaft 12, are five coaxial rotor discs 15, over the circumference of which holders are respectively distributed, which serve to receive rotor tools 16. In the operation of a device according to the invention, therefore, the rotor tools 16 describe a common circle of rotation around the axis of rotation 11.

Stator tools 20 are located opposite the rotor tools 16 at a close radial distance. The stator tools 20 are supported within holders 21, together with which they form the tool units 22.

Figure 4:
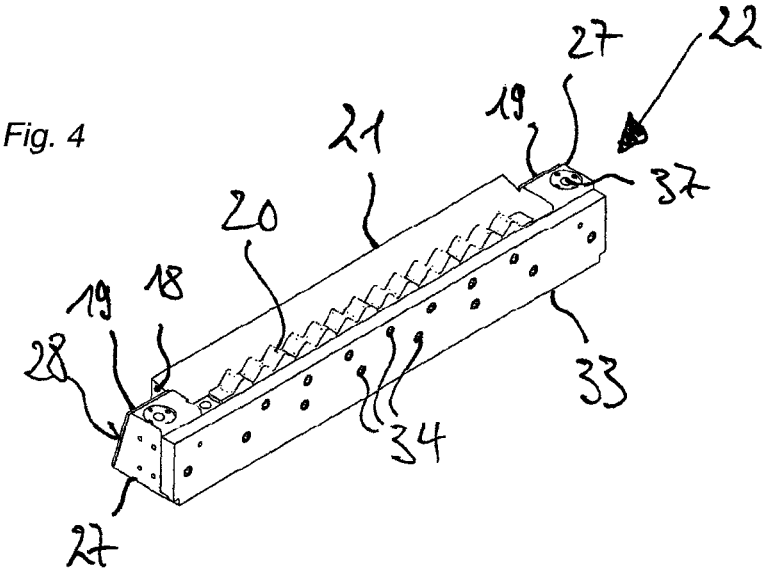
FIG. 4 is an oblique view of a device shown in FIGS. 1-3.
Figure 5A:
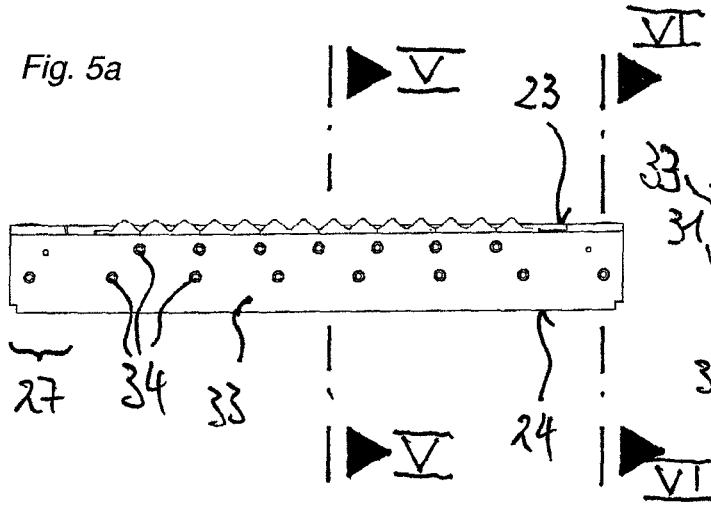
FIG. 5*a* is view of the front side of the tool unit shown in FIG. 4.
Figure 5B:
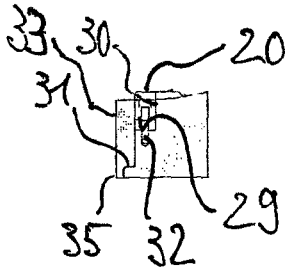
FIG. 5*b* is a cross section through the tool unit shown in FIG. 5*a* along the line there, V-V.
Figure 6A:
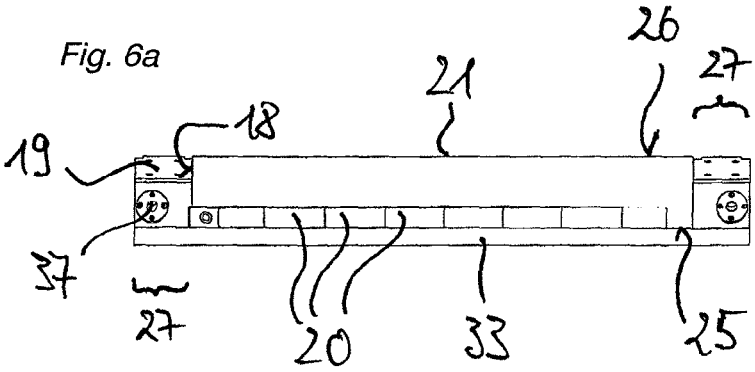
FIG. 6*a* is a top view of the tool unit shown in FIG. 4.
Figure 6B:
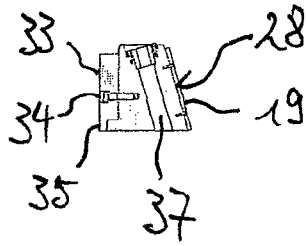
FIG. 6*b* is a cross section through the tool unit shown in FIG. 5*a* in the area of its end sections along the line there, VI-VI.

FIGS. 4, 5*a, b* and 6*a, b* show the more detailed design of the tool units 22. The holder 21 of each tool unit 22 is designed as a beam with an inner side 23 facing the axis of rotation 11, an opposite outer side 24, as well as a front side 25 and an opposite back side 26 (FIGS. 5*a*, 6*a*). Except for the end sections 27, the holder 21 has an essentially rectangular perimeter; the end sections 27, on the other hand, each have on their back side an offset 18 increasing from the outside 24 in the direction toward the inside 23, as a result of which the end sections 27 each have a wedge-shaped cross section with a wedge surface 28, which, as will be explained later in further detail, serve for clamping the tool units 22 to the housing 1. The wedge surface 28 in this process can be lined with a replaceable fill plate 19, so that different thicknesses of the fill plate 19 can modify the wedge height and thus the relative radial position of the tool unit 22 relative to the rotor tools 16.

The front side 25 of the tool unit 22 is machined in the area between the end sections 27 to form a one-piece receptacle for the stator tools 20. The receptacle comprises a first support surface 29 extending lengthwise in a tangential plane and a second support surface 30 traveling at a right angle to this, lying in an axial plane. In addition, a strip-shaped extension 31 is formed along the longitudinal edge of the holder 21, formed by the outer side 24 and the front side 25.

In the recess formed in this way, the stator tools 20 are placed and clamped with screws 32 against the first support surface 29, optionally with insertion of adjusting plates between the first support surface 29 and stator tools 20 to adjust the radial projection of the stator tools 20. In this process the active edges of the stator tools 20 project over the inside 23, and in the operating position, form the previously mentioned working gap with the rotor tools 16.

Additional clamping of the stator tools 20 is accomplished by a clamping plate 33, which is clamped with the aid of a plurality of screws 34 against the front side 25 of the holder 15 and in so doing presses the stator tools 20 against the second support surface 30, wherein here also adjustment plates may be inserted between the stator tool 20 and the second support surface 30. The clamping plate 33 ends flush with the inner side 23 of the holder 21 and on the opposite side is supported on the extension 31, wherein a lip 35 formed on the clamping plate 33 covers the front side of the extension 31.

In the area of the end section 27, in addition, a penetrating hole 37 traveling parallel to the wedge surface 28 is introduced, which has internal threading at least over part of its length and the purpose of which will be discussed in further detail in the following.

Even though not illustrated in the drawing, the term "tool unit" also includes embodiments in which only reinforced stator tools extend from one transverse wall to the other transverse wall of the housing. The tool unit is thus formed monolithically.

A tool unit 22 prepared outside of the device in this way is disposed inside the device in accordance with the invention in the area of the lower vertex of the rotor 10 and relative to the axis of rotation 11 with the same angular distance of about 120° toward both sides in the area of the rotor 10 near the circumference and in an axially parallel position to this. For fastening the lower tool unit 22, in each of the transverse walls 2 an opening 36 is provided, the width of which is adapted to the wedge-shaped cross section of the end section 27, in other words the opening 36 narrows toward the axis 11. In the radial direction, on the other hand, the opening 36 is somewhat higher than the holder 21 including the projection of the stator tool 20 over the inner side 23 to permit axial sliding of the tool unit 22 into and out of the housing 1 through the opening 36. This can take place semiautomatically with the aid of the cylinder piston unit 17 disposed axially in the lower area of the housing 1, for which purpose the axially movable piston of said unit extends through the housing wall 2 and is coupled with the tool unit in a push-pull force transmitting manner outside the housing 1. In the intended operating position of the tool unit 22, the end sections 27 extend through the openings 36. In this process the triangular surfaces formed by the offset 18 in the area of the end sections 27 are adjacent to the transverse walls 2, which in this manner act as axial stops.

The end sections 27 of the lower tool unit 22 are each held in a clamping device 40 (FIG. 3). Here the embrasure surface of the opening 36 forms a radially acting support surface 41 and on both sides of this are adjacent lateral support surfaces, against which the tool unit 22 is clamped by via a pressure surface 42. By appropriately selecting the thickness of the fill plates 19, the depth of insertion of the tool unit 22 in the opening 36 can be selected in advance. The pressure surface 42 is formed by a wedge 43 which is supported movably on mounting bracket 44 connected permanently with the outside of the transverse wall 2. The clamping movement of the wedge 43 is created by a threaded pin 45, which extends with one end into the front face of the wedge 43 and with the other end is supported over a threaded nut against a fixed-position support plate 46. The clamping movement of the wedge 43 leads to a relative approximation of the pressure surface 42 and the first support surface 29.

According to an embodiment of the invention that is not shown, the pressure surfaces could also be formed in each case by the piston of a hydraulic press, which generates a clamping force perpendicular to the longitudinal extension direction of the tool units 22.

For installation and removal purposes, an additional lifting and holding mechanism 47 is provided, with an angular retaining part 48, the radial arm of which is screwed onto the front face of the tool unit 22 and through the axially traveling arm of which a threaded pin 49 is passed. The end of the threaded pin 49 again meshes in a threaded hole in the mounting bracket 14. By screwing the threaded pin 49 in or out or by screwing or unscrewing a nut on the threaded pin 49, the tool unit 22 can be lifted or lowered in a controlled manner.

This method of fastening the lower tool unit 22 basically can also be applied in the case of the upper tool units 22. In addition, however, an alternative embodiment of the fastening is described. Thereby the upper tool units 22 each lie in recesses 50 which extend radially inward from the edge of the transverse wall 5. The shape of the recesses 50 in turn corresponds to the cross section of the end sections 27 of the tool units 22, wherein the embrasure surface of the recess 50 forms the bearing surface 41 lying in a tangential plane and lateral bearing surfaces adjacent to it on both sides, on which the end sections 27 are respectively under contact. Here also, by appropriately selecting the thickness of the fill plates 19 the insertion depth of the tool units 22 in the recesses 50 can be preselected.

The clamping device 40 for fixing the tool unit 22 in the recesses 50 is formed by clamping beams 51, which on their underside facing the housing 1 have a piston-like projection which presses on the outside of the end sections 27 of the tool units 22. With the aid of screws 53, the clamping beams 51 are clamped in the direction of the tool units 22.

Between the recesses 50 and the drive shaft 12, in each case a mounting bracket 54 is seen, which supplies an abutting surface for a radially extending threaded spindle 55 used temporarily for removal purposes. The threaded spindle 55 extends through the penetrating hole 37 parallel to the wedge surface 28 and meshes with the threaded section inside the penetrating hole 37. By screwing in the threaded spindle 54, therefore, a radially directed lifting force can be exerted on the upper tool unit 22.

Basically it is possible to use this type of fastening in the case of the lower tool unit 22 as well.

The circumferential sections between the lower tool unit 22 and the two upper tool units 22 are closed by sieves 56, which are fixed on pivotable sieve frames. The input material comminuted adequately during the work-up passes through the sieve 56 and leaves the device through the housing 1 open at the bottom.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for processing free-flowing input material, the device comprising:

a housing;

a rotor disposed within the housing, the rotor rotating around an axis that is fitted over a circumference thereof with rotor tools; and stator tools disposed in a permanent position with respect to the housing, the stator tools configured to maintain a working gap and are configured to be disposed opposite the rotor tools to interact with the rotor tools for processing the input material, wherein each of the stator tools is held within a holder to form a tool unit, the tool unit being configured to be cantilevered over a length of the rotor, wherein end sections of the tool unit are removably fixed in clamping devices, wherein each of the clamping devices comprise a bearing surface and a pressure surface between which an end section of the tool unit is disposed and clamped, and wherein the pressing surface acts transverse to the longitudinal extension direction of the tool units.

2. The device according to claim 1, wherein each of the clamping devices are arranged in axially opposite housing walls.

3. The device according to claim 1 , wherein the pressure surface is formed by an inclined surface of a wedge abutting against an abutment, the wedge being movable relative to the tool unit.

4. The device according to claim 1, wherein the pressure surface is formed by an underside of a clamping beam that is clamped against the housing.

5. The device according, to claim 1, further comprising a lifting and holding device acting transverse to the bearing surface, the lifting and holding device being coupled indirectly or directly with the end sections of the tool unit.

6. The device according to claim 5, wherein the lifting and holding device comprises a threaded pin that meshes into a threaded hole disposed opposite the housing and which is anchored rotatably with its head in the tool unit or a retaining piece connected permanently with the tool unit.

7. The device according to claim 1, wherein the holder for the stator tools has a recess with a first bearing surface lying in a tangential plane relative to the axis of rotation and a second bearing surface lying in an axial plane.

8. The device according to claim 7, wherein adjusting plates are configured to be provided between the first bearing surface and/or the second bearing surface and the stator tools.

9. The device according to claim 1, wherein the tool unit comprises a clamping plate with which the stator tools are clamped against the holder.

10. The device according to claim 9, wherein a strip-like projection is molded onto the holder, the projection being a support surface for the clamping plate.

11. The device according to claim 1, wherein the end sections of the tool units have a wedge-shaped cross section that tapers in a direction of an inner side.

12. The device according to claim 11, wherein the wedge surface is covered with a fill plate.

13. The device according to claim 1, wherein the tool unit is releasably mounted to the housing by the clamping device.

14. A device for processing free-flowing input material, the device comprising:

a housing;

a rotor disposed within the housing, the rotor rotating around an axis that is fitted over a circumference thereof with rotor tools; and stator tools disposed in a permanent position with respect to the housing, the stator tools configured to maintain a working gap and are configured to be disposed opposite the rotor tools to interact with the rotor tools for processing the input material, wherein each of the stator tools is held within a holder to form a tool unit, the tool unit being configured to be cantilevered over a length of the rotor, wherein end sections of the tool unit are removably fixed in clamping devices, and wherein each of the clamping surfaces are disposed on an outside of a housing wall and the end sections of the tool unit are passed through openings in the housing wall.

15. The device according to claim 14, wherein bearing surfaces are formed by an embrasure surface of the openings in the housing wall.

16. The device according to claim 14, wherein the opening in the housing wall is covered over its entire circumference.

17. The device according to claim 14, wherein the openings in the housing wall are open toward an edge of the housing wall.

18. A device for processing free-flowing input material, the device comprising:

a housing;

a rotor disposed within the housing, the rotor rotating around an axis that is fitted over a circumference thereof with rotor tools; and stator tools disposed in a permanent position with respect to the housing, the stator tools configured to maintain a working gap and are configured to be disposed opposite the rotor tools to interact with the rotor tools for processing the input material, wherein each of the stator tools is held within a holder to form a tool unit, the tool unit being configured to be cantilevered over a length of the rotor, wherein end sections of the tool unit are removably fixed in clamping devices, wherein each of the end sections of the tool units through the formation of an offset, have a smaller cross section than a central longitudinal section, and wherein a surface formed by the offset is an axially acting limit stop surface.

* * * * *